US005444258A

United States Patent [19]

Grigoryan et al.

[11] Patent Number: 5,444,258

[45] Date of Patent: Aug. 22, 1995

[54] ION-OPTICS SYSTEM FOR A SOURCE OF IONS TO BE DISCHARGED INTO A GAS

[75] Inventors: Vladimir G. Grigoryan; Valeriy I. Minakov; Vladimir A. Obukhov; Petr P. Ogadjanov, all of Moscow, Russian Federation

[73] Assignee: Societe Europeenne de Propulsion, Suresnes, France

[21] Appl. No.: 211,676

[22] Filed: Apr. 12, 1994

[51] Int. Cl.[6] ..... H01J 27/02

[52] U.S. Cl. ..... 250/423 R; 313/360.1; 313/363.1

[58] Field of Search ..... 250/423 R; 313/360.1, 313/363.1, 350, 147; 315/111.81, 111.31; 60/202

[56] References Cited

U.S. PATENT DOCUMENTS

| | | | |
|---|---|---|---|
| 3,096,456 | 7/1963 | Shelton et al. | 60/202 |
| 3,457,405 | 10/1966 | Del Vecchio | 250/49.5 |
| 3,922,578 | 11/1975 | Wilson | 313/278 |

FOREIGN PATENT DOCUMENTS

| | | | |
|---|---|---|---|
| 0247316 | 12/1987 | European Pat. Off. . | |
| 0406441 | 7/1990 | European Pat. Off. . | |
| 2482777 | 11/1981 | France . | |
| 62-113345 | 5/1987 | Japan . | |
| 2-239559 | 9/1990 | Japan | 250/423 R |
| 5-126028 | 5/1993 | Japan | 60/202 |
| 6-12995 | 1/1994 | Japan | 250/423 R |

OTHER PUBLICATIONS

"Thermal and Structural Analysis of the LBL 10×40 CM Long Pulse Accelerator and the 12×48 CM Common Long Pulse Accelerator for TFTR Doublet III-D, and MFTF-B", R. P. Wells, Fusion Engineering, 11th Symposium Proceedings, vol. 1, Nov. 22, 1985, Austin Texas, pp. 160-165.

"Minimum Hole Size in Ion Optics", H. R. Kaufman, J. Spacecraft and Rockets, vol. 22, No. 3, Jun. 1985, pp. 381-382.

*Primary Examiner*—Jack I. Berman

*Attorney, Agent, or Firm*—Weingarten, Schurgin, Gagnebin & Hayes

[57] ABSTRACT

The present invention provides an ion-optics system for a source of ions for discharge into gases, the system comprising a screen grid (1) and an accelerator grid (2) constituted by respective frames (3, 4) and respective systems of parallel wires (5, 6) fixed to the frames by means of springs (21), the frames of the grids being assembled to each other via insulators (7) to which they are fixed, the system being provided with a displacement device (9) for adjusting the wires in each of the grids, which device comprising rolls (11) disposed transversely relative to the wires in each grid and offering guide elements (12) in which the wires are placed, the rolls being installed on the frames of the grids with the facility of rotating about their own axes and of changing position in three dimensions together with the wires. Preferably, in a first embodiment, each roll is mounted by means of a length of shaft that is hinged to the frame and by means of an opposite length of shaft installed in an eccentric sleeve mounted in the frame with the option of rotating about its axis. In another embodiment, each roll installed via its lengths of shaft in eccentric sleeves disposed in the frame with the possibility of rotating about their axes, one of the lengths of shaft of each roll being hinged to its eccentric sleeve.

12 Claims, 6 Drawing Sheets

ION-OPTICS SYSTEM FOR A SOURCE OF IONS TO BE DISCHARGED INTO A GAS

FIELD OF THE INVENTION

The present invention relates to the field of sources of ions for discharging into gases, and more exactly it relates to an ion-optics system for a source of ions for discharging into a gas, and it may be used in systems for forming intense ion beams.

PRIOR ART

Ion-optics systems are already known for sources of ions for discharging into a gas, which systems comprise two (or more) electrodes formed by flanges and grids in the form of flat disks having holes (H.R. Kaufman and R.S. Robinson, Minimum Hole Size in Ion-optics/J. Spacecraft and Rockets 1985, Vol. 22, No. 3, pp. 381-382).

However, such known ion-optics systems constituted by flat grids having cylindrical orifices in alignment deform in operation under the effect of thermal stresses due to the structure heating, thereby compromising the aligned nature of the orifices and causing variation in the clearance between the grids (modification of geometrical parameters), which may give rise to variation in the perveance of each elementary optical component, and in the event of the clearance being reduced, may give rise to an increase in electrostatic forces that can cause the grids to come into contact, thus establishing a short circuit. In addition, the diameter of plane ion-optics is limited in practice to 100 mm.

A known remedy applied to ion sources for use in space consists in using (spherically) bulging grids that are much less sensitive to thermal deformation and to the destabilizing influence of electrostatic forces.

Nevertheless, that technology suffers from the drawback of being very complex and particularly expensive.

When traditional grids are used in an ion-optics system, the grids having perforated round orifices whose axes are at the vertices of equilateral triangles, the transparency $\delta F$ of the grid (the ratio of the total area of the orifices of diameter d to the total area of the grid) is given by a known formula:

$$\delta F = 0.91\, d^2/(d+1)^2$$

An increase in transparency makes it possible to use the surface that is the source of ions more efficiently; since the current density through the ion-optics system decreases with increasing orifice diameter d, it is desirable to make grids in the form of disks having small holes and high transparency. To do this, it is necessary for the width of the bridge 1 between orifices to be at least 0.5 mm, and technologically that is not easy. With such a configuration having round orifices, the maximum transparency that can be obtained for the screen grid is of the order of 0.67. However, the use of hexagonal orifices makes it possible to raise said maximum value to 0.7.

An ion-optics system for a source of ions for discharging into a gas is also known that includes an accelerator grid and a screen grid both formed of parallel wires fixed on frames by spring blades and constituting outlet slots, associated with groups of insulators on which the frames are installed (SU-A-472396).

By using such electrodes made of frames carrying wires, it is possible for the system to have orifices of small diameter, thereby giving the ion-optics system high transparency, greater than 0.7.

However, in that type of ion-optics system with clearance (slots) between wires of the grids of 0.3 mm to 0.5 mm, operating stability is observed to be poor. This is associated with difficulties in mutual positioning of the wires in the screen grid or the accelerator grid. Positioning inaccuracy can give rise to ions being captured by the accelerator grid and to it wearing quickly, thereby giving rise to disturbance in the operation of the ion source.

DESCRIPTION OF THE INVENTION

The object of the invention is to provide an ion-optics system for a source of ions for discharging into a gas having a structure that makes it possible to establish and keep constant the three-dimensional positioning of the electrode wires during operation of the ion source, and to improve the operating stability of the system while conserving high transparency.

According to the invention, this problem is solved by an ion-optics system for a source of ions for discharge into a gas, the system comprising a screen grid and an accelerator grid constituted by respective frames and respective systems of parallel wires fixed to the frames by means of springs, the frames of the grids being assembled to each other via groups of insulators to which they are fixed, in which the system is provided with a displacement device for adjusting the wires in each of the grids, which device comprises rolls disposed transversely relative to the wires in each grid and offering guide elements in which the wires are placed, the rolls being installed on the frames of the grids with the facility of rotating about their own axes and of changing position in three dimensions together with the wires.

Each roll of the displacement device for adjusting the wires may be mounted by means of a length of shaft that is hinged to the frame and by means of an opposite length of shaft installed in an eccentric sleeve mounted in the frame with the possibility of rotating about its axis.

In a variant embodiment of the displacement device, each roll is installed via two opposite lengths of shaft in eccentric sleeves disposed in the frame with the possibility of rotating about their axes, one of the lengths of shaft of each roll being hinged to its eccentric sleeve. Thus, by rotating the two eccentrics simultaneously it is possible to vary the inter-grid distance, while differential rotation of the eccentrics makes it possible to compensate for the two grids not being exactly coplanar.

In this system, the displacement device for adjusting the wires makes it possible, if necessary, to place the wires in each grid at an accurate pitch and to fix them with given clearance between the grids, thus making it possible to change the geometry of the slots and the trajectory of moving charged particles. The possibility of moving the wires for adjustment purposes and the use of springs makes it possible in operation, during heating of the grids to keep the wires in their three-dimensional positions, which for a given beam current excludes ion capture and any risk of inter-grid discharge.

This improves the operating stability of the system in general, its reliability, and the lifetime of the grids.

The rolls receiving the wires in their guide elements make it possible, during motion of the rolls about their axes, to perform simultaneous displacement of the wires until their axes become parallel in both grids.

This makes it possible to perform fine adjustment of the clearance between grids.

In accordance with the invention, it is advantageous to make the roll guide elements in the form of screw threads at a pitch that is equal to the pitch of the wires or that is smaller than said pitch and in an integer ratio thereto, thereby guaranteeing very reliable adjustment of the positions of the wires in each grid.

It is advantageous for the diameter of the wires in the accelerator grid to be greater than the diameter of the wires in the screen grid, which makes it possible to reduce the probability of neutral particles passing through the ion-optics system and to increase the perveance of the ion-optics. After interacting with the accelerator grid, the particles return into the gas discharge, which generally increases the gas efficiency of the ion source.

Similarly, it is also advantageous to dispose the wires of the screen grid at a pitch that is smaller than the pitch of the wires of the accelerator grid, with the pitches being at an integer ratio, thus making it possible to increase the operating stability of the ion-optics system by stabilizing the frontier of the plasma.

In sections equal to the pitch of the wires in the accelerator grid, the rolls of the screen grid may have a profile such that the distance between the wires of the screen grid and the plane in which the wires of the accelerator grid are disposed in each section to increase going from the edges towards the center thereof.

This makes it possible to control the divergence angle of the ion beam and to keep it within the required limits with high accuracy.

In accordance with the present invention, the wires of the grid may be made out of two coaxial portions, with the outer portion being made in the form of a removable tube that is installed as a good fit on the inner portion.

If the wires of the accelerator grid are made up of two coaxial portions, the inner portion of each wire is preferably of a diameter equal to the diameter of the wires of the screen grid. This makes it possible to increase the lifetime of the wire grids by increasing the volume of material that can be pulverized by the recharging ions before the grid becomes unusable. The design of wires comprising two coaxial portions makes it possible to perform fixing and tensioning solely on the inner portions of the wires, which nevertheless offer the total desired thickness. This simplifies the wire fixing assembly, reduces its mass and bulk, and enlarges the range of grid materials that can be used.

It is advantageous to replace each wire of the screen grid with three or more wires disposed in a given geometrical pattern.

In accordance with the invention, it is advantageous to install springs in parallel with the rolls, the springs being for fixing the grid wires and forming at least one row on each side of the frame of the grid, which springs are spring blades of a thickness corresponding to the pitch of the grid wires. This makes it simpler to fix the wires while keeping their axes parallel, and it makes it possible to make all of the grid wires using a single continuous wire, thereby simplifying grid integration technology.

In a variant embodiment of the invention, the springs are disposed on each frame of the grid in a plurality of rows, the springs of adjacent rows being mutually offset through a distance that is a multiple of the pitch of the thread of the rolls. That makes it possible to place the wires at a given minimum pitch without being limited by the size of the springs.

The ion-optics system proposed above provides reliable operation for the source of ions for discharging into a gas with parameters that remain stable over time, and it improves the lifetime of the grids, and of the entire system in general, while also improving the efficiency of the source.

BRIEF DESCRIPTION OF THE DRAWINGS

The invention will be better understood from a detailed description of an embodiment given with reference to the drawings, in which.

PREFERRED EMBODIMENT OF THE INVENTION

Figure 1:
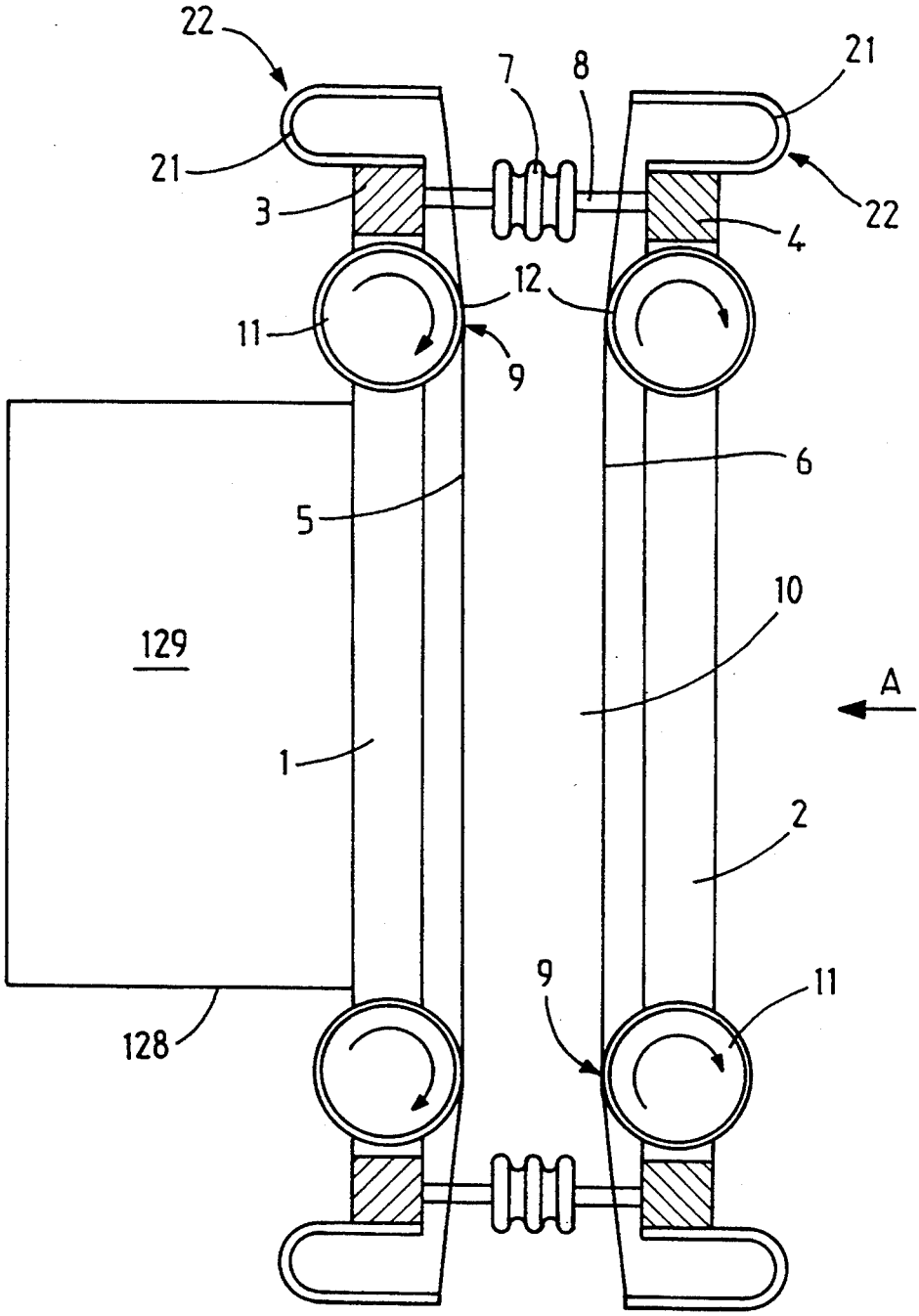
FIG. 1 is a cross-section through a two-grid ion-optics system of the invention.

The ion-optics system for a source of ions for discharging into a gas of the invention comprises (FIG. 1): a screen grid 1 and an accelerator grid 2, respectively constituted by frames 3 and 4 and by systems of parallel wires 5 and 6 together with insulators 7 provided with metal ends 8 on which the frames 3 and 4 of the grids 1 and 2 are respectively mounted. A displacement device 9 for adjusting the wires in each of the grids 1 and 2 (which grids are installed at the appropriate distance from each other) serves to determine inter-grid clearance 10.

The ions are extracted through the screen grid from the plasma 129 produced by the ionization chamber 128.

Figure 2:
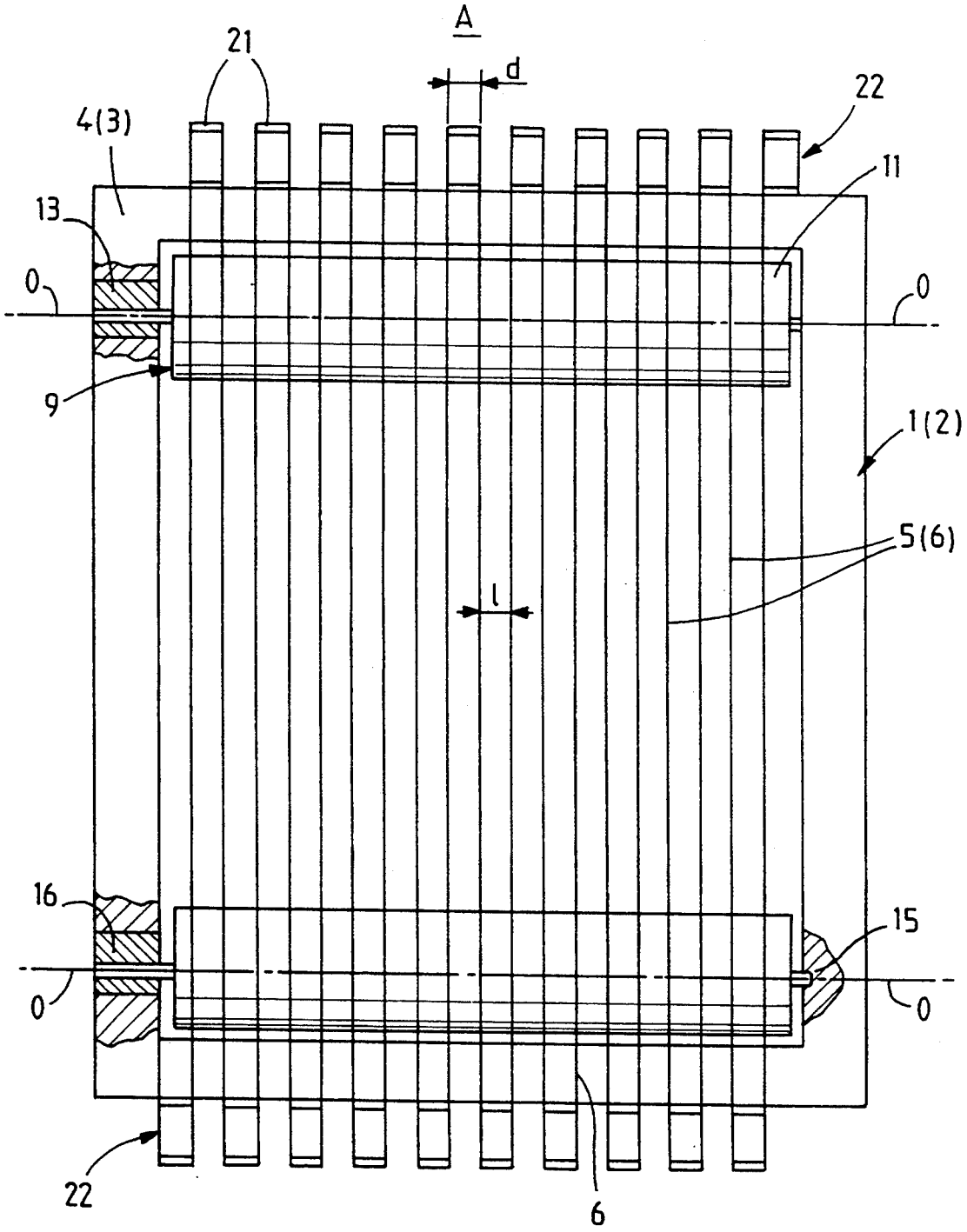
FIG. 2 shows the object of FIG. 1 as seen along arrow A.

The displacement device 9 for adjusting the wires 5 and 6 in the electrodes 1 and 2 respectively comprises rolls 11, e.g. disposed in pairs in each grid 1, 2 transversely to the wires 5 and 6, as shown in FIG. 2, together with guide elements 12 (e.g. grooves, FIG. 1) that are provided in the outside surfaces of the rolls 11. The wires 5, 6 of the grids 1, 2 pass through the guide elements 12 that are implemented in the form of circular grooves 13 (FIG. 3) or in the form of a screw thread 14 (FIG. 4) at a pitch h equal to the pitch $h_1$ of the wires or that is smaller than said pitch by an integer ratio, thus making it possible, where necessary, to place the wires in each grid 1 or 2 at a specified pitch.

The rolls 11 (FIG. 2) of each device 9 are installed in the frame 3, 4 of each grid 1, 2 in such a manner as to be capable of rotating about their respective axes O—O and of changing their positions in three dimensions together with the wires.

Each roll is mounted by a length of shaft that is hinged at 15 in the frame of a corresponding grid 1 or 2

Figure 5:
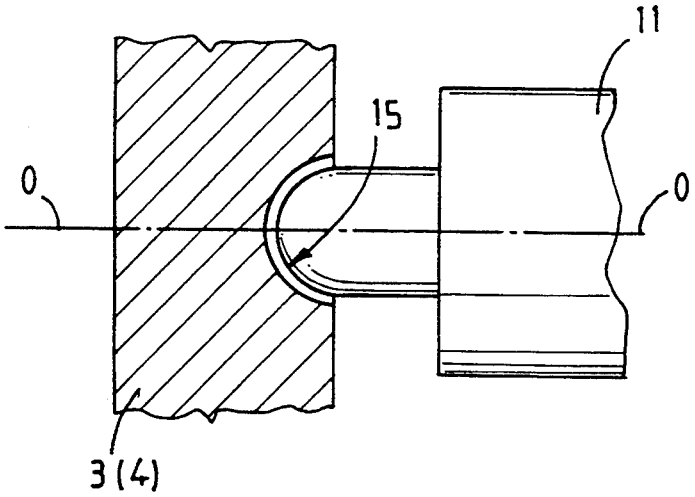
FIG. 5 shows the roll mounted in a simple recess.

(FIG. 5) and by an opposite length of shaft that is received in an eccentric sleeve 16 (FIG. 6) disposed in the frame 3 or 4 with the facility of rotating about its own axis $O_1$13 $O_1$. Rotation of each roll 11 about its axis O—O and rotation of the sleeves about their axes $O_1$—$O_1$ can be achieved by any appropriate means, e.g. by means of a screwdriver, as shown in chain-dotted lines. To this end, a screwdriver-receiving slot is provided in the center of each sleeve 16 and at the end 17 of each roll 11. After rotation, the eccentric sleeve 16 and the roll 11 can be locked, e.g. by means of a wedge 19 inserted between the frame 3, 4 and the sleeve 16, and by means of a wedge 20 inserted between the sleeve 16 and the end 17 of the roll 11, slideways being provided in the body of the frame and in the sleeve for receiving the wedges 19 and 20.

In a variant of the device 9, each of its rolls 11 (FIG. 7) is installed via its two lengths of shaft 17 in two eccentric sleeves 16 disposed in the frames 3, 4 each having the ability to rotate about its own axis, one of the lengths of shaft (in this case the end 17) of each roll 11 being coupled to the corresponding eccentric sleeve 16 by means of a pivot 15. This makes it possible to move the rolls 11 in three dimensions (or to move the rolls over the pivot surface), and in particular to adjust separately the mean distance 10 between the grids and the parallelism of the grids.

Figure 6:
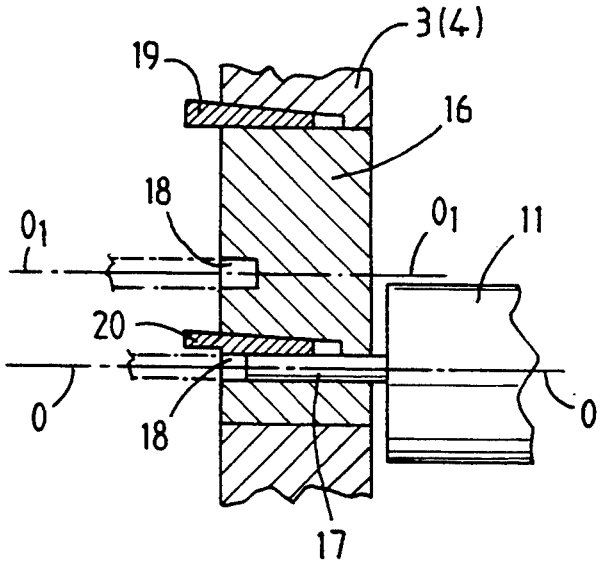
FIG. 6 shows the roll mounted in an eccentric together with associated locking devices.
Figure 7:
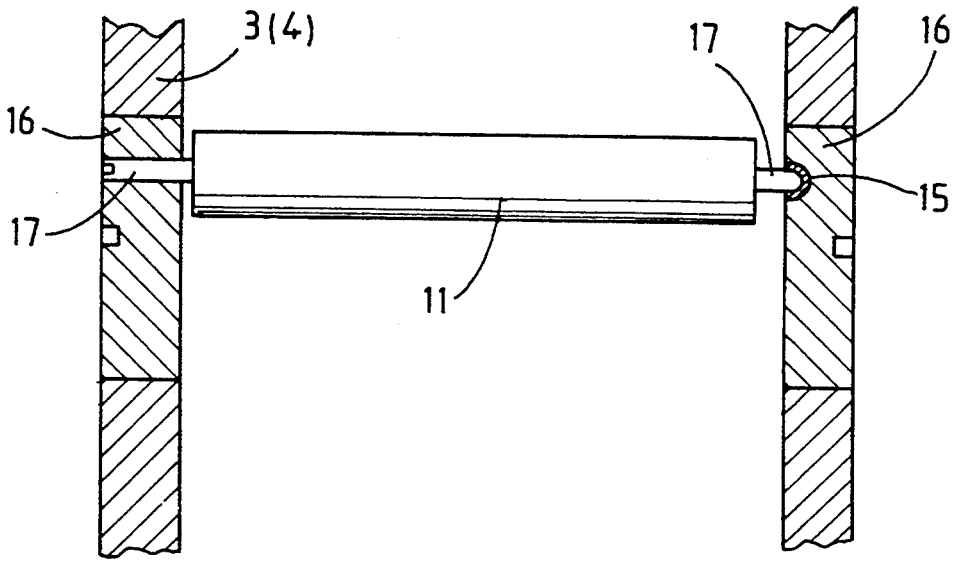
FIG. 7 shows a variant embodiment of the fixing of rolls in a grid frame.

After the rolls 11 have rotated about their own axes and after the eccentric sleeves 16 have rotated, they are fixed in position in the same manner as that described for the embodiment of FIG. 6, e.g. using wedges (which are not shown in FIG. 7).

Figure 8:
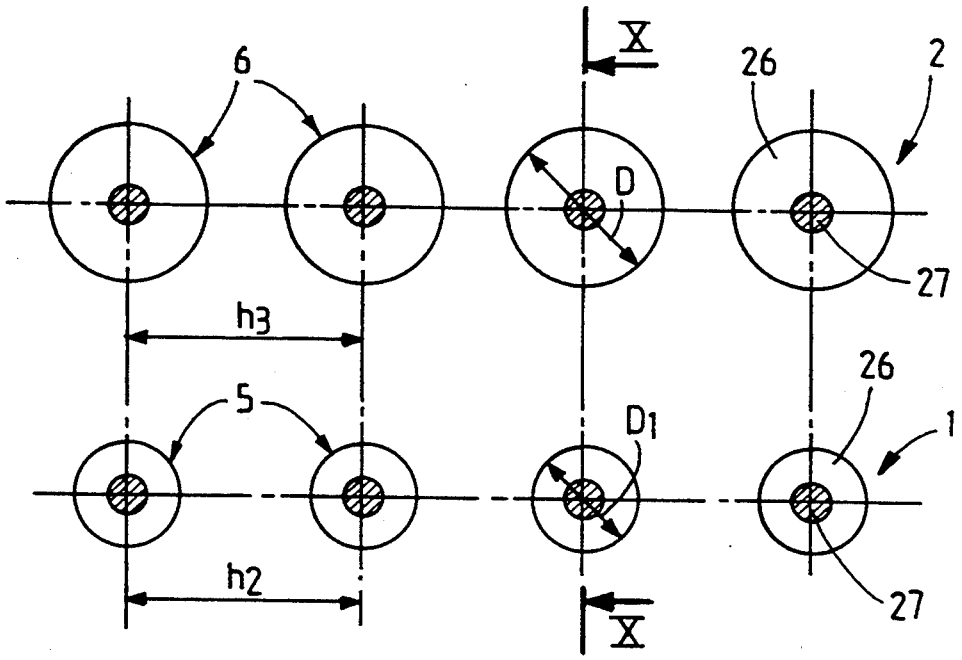
FIG. 8 shows a screen grid and accelerator grid assembly provided with tubes mounted on the wires.
Figure 9:
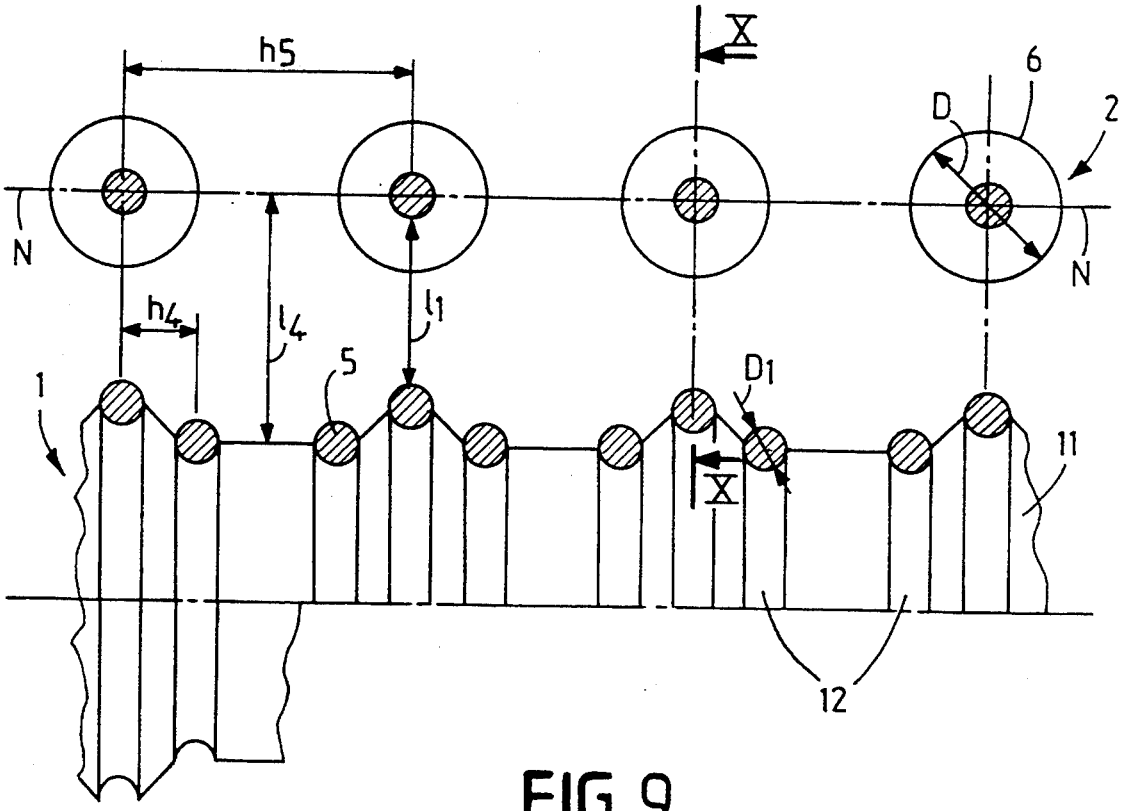
FIG. 9 shows an accelerator grid in which each individual wire is replaced by at least three wires.

Depending on the field in which ion-optics systems of the invention are used, the wires 5 of the screen grid 1 are disposed at a pitch $h_2$ equal to the pitch $h_3$ of the wires 6 of the accelerator grid (FIG. 8), or at a pitch $h_4$ smaller than the pitch $h_5$ of the wires 6 of the accelerator grid 2 (FIG. 9) by an integer ratio, with the smaller pitch having the result that a single slot in the accelerator grid 2 is permeable to ion beams formed by a plurality of slots in the screen grid 1 (three of them in the example of FIG. 9). The wires 6 of the accelerator grid 2 are of a diameter D that is greater than the diameter $D_1$ of the wires 5 of the screen grid 1 so that the transparency of the screen grid 1 is greater than the transparency of the accelerator grid 2, thereby achieving higher efficiency for the system in gas, ion transparency of the ion-optics system being determined under such circumstances by the transparency of the screen grid 1 while atom transparency is determined by the transparency of the accelerator grid 2.

In the ion-optics system, where the inter-grid clearance 10 is small, e.g. less than 1 mm, and when the currents are close to limits, it is difficult to keep the divergence angle of the ion beam within given limits; the rolls 11 of the device 9 situated in the screen grid 1 are of varying diameter (see FIG. 9) over a section equal to the pitch $h_5$ of the wires 6 of the accelerator grid 2, the distance $l_1$ between the wire 5 of the screen grid 1 and the plane N—N that contains the wires 6 of the accelerator grid 2 increases up to $l_4$ when going from the edge to the middle of the section.

Figure 3:
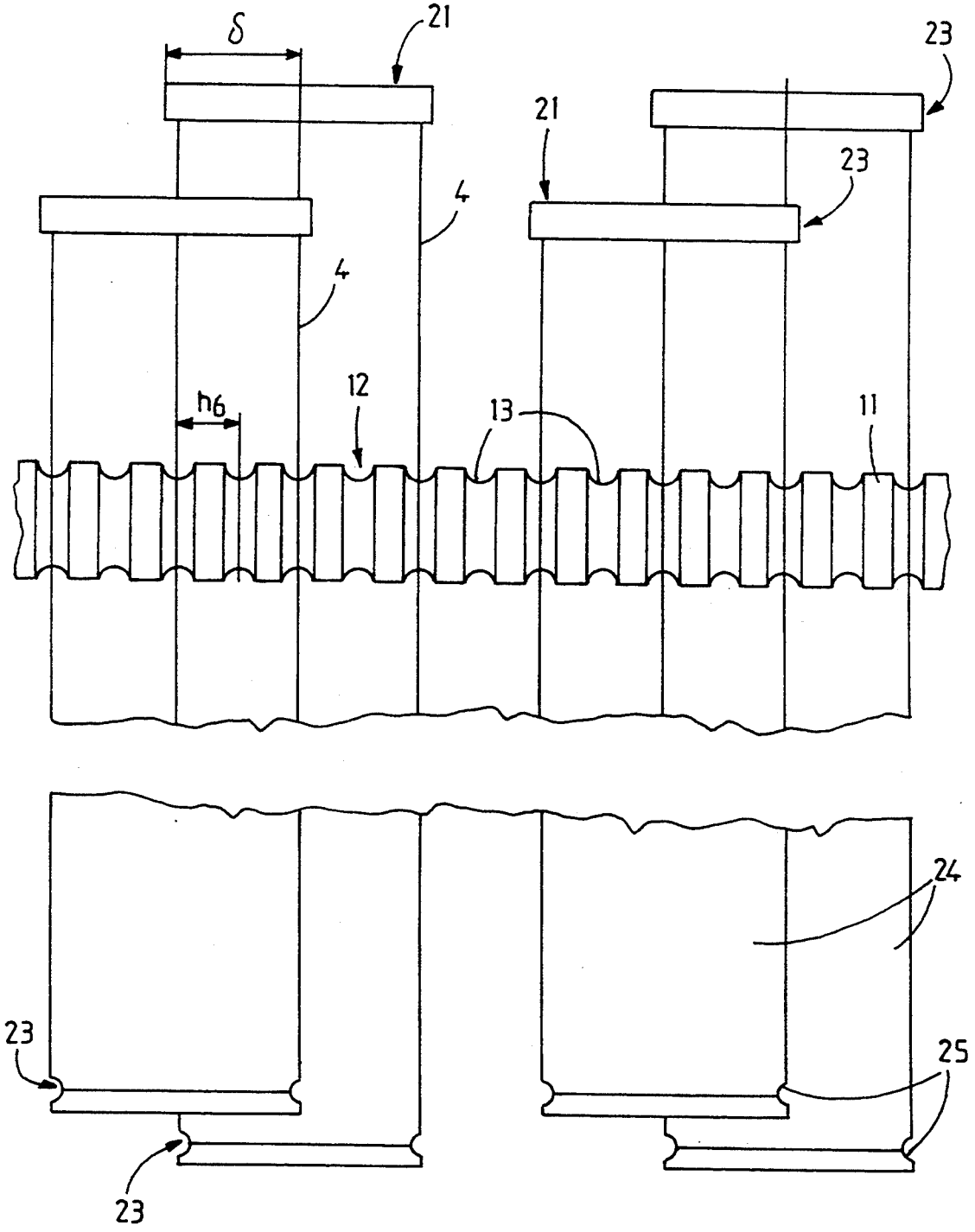
FIG. 3 shows a variant embodiment of the grids in which the springs are disposed in two rows.
Figure 4:
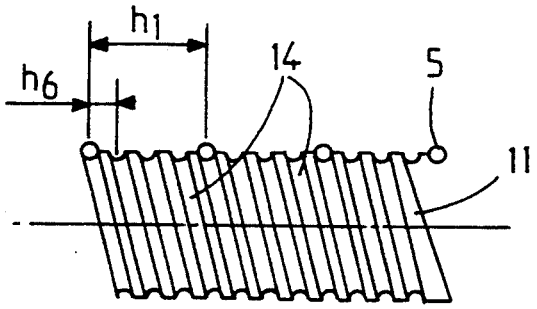
FIG. 4 shows a detail of the embodiment of the roll in which the grooving of the roll is replaced by a thread.

The wires 5 and 6 of the grids 1 and 2 are fixed to springs 21 (FIGS. 1 and 2) that are in alignment parallel with the rolls 11 of the device and that are placed in a single row 22 along each of opposite sides of the frames 3, 4 of the grids 1, 2. As shown in FIG. 3, the springs in adjacent rows are offset from one another by a distance 6 which is a multiple of the pitch $h_6$ of the guide elements 12 of the rolls 11.

Each spring 21 is implemented in the form of a spring blade 24 fixed at one end to the frame 3, 4 and having lateral grooves 25 through which the wires are passed, the width of a spring 24 being a multiple of the pitch of the guide elements 12. Such a configuration makes it possible to place the wires at a given pitch, e.g. less than 1 mm, and also to make the wires of the grids 1 and 2 from continuous wire.

To reduce the load of the springs 21, the grid wires are made of two coaxial portions 26 and 27 (FIGS. 8 to 10) with the outer portion 26 forming a tube 28 (FIG. 10) that is installed as a good fit on the inner portion 27. When only the wires 6 of the accelerator grid 2 are implemented as two coaxial portions 26 and 27, the inner portion 27 of such wires has a diameter equal to the diameter of the wires 5 in the grid 1. This technique of making the grid wires (particularly for the accelerator grid) establishes the possibility of quickly replacing the worn portion 26 that has been reduced because of its material being eroded during operation of the source, thus making it possible to increase the lifetime of the grids by increasing the thickness thereof.

Figure 10:
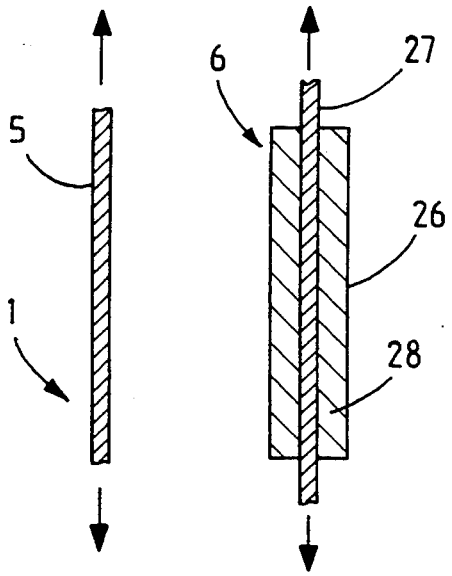
FIG. 10 is a cross-section on X—X of FIG. 8 and/or FIG. 9.

The ion-optics system of the invention is operated in conventional manner: a potential corresponding to the energy of the ions in the beam, e.g. +2 kV is applied to the screen grid 1 (FIG. 1) while a potential of −0.2 kV to −2 kV is applied to the accelerator grid 2, which is necessary to establish an extraction potential difference. The outlet grid (not shown) is normally implemented in the form of an annular grid or in the form of a frame and it is grounded. In the discharge chamber of the source, it is necessary to place the substance of the plasma 129 in the slots of the screen grid 1 from which the accelerated ions depart into the ion-optics system. By using wires 5 and 6 built up as shown in FIGS. 8, 9, and 10 in the grids, and by using rolls 11 designed as shown in FIG. 9, it is possible to achieve the specified transparency for the accelerator grid 2 and for the screen grid 1 and the divergence of the ion jet does not exceed the specified values. Thus, by replacing each wire of the screen grid with three or more wires disposed in a determined geometrical pattern, it is possible to determine more accurately both the equipotentials in the acceleration zone and the plasma limit in the ionization chamber.

If it is necessary to achieve a specified shape for the surface of each grid and to cause the wires to coincide, then the positioning of the wires is initially adjusted using the device 9.

The specified shape for each grid can be achieved by rotating the eccentric sleeves 16 (FIG. 2), thereby causing the wires to move in a direction perpendicular to the plane of the frame. The eccentric sleeves 16 are fixed in a new position by means of the wedges 19.

Coincidence is obtained between the slots of the screen grid 1 and of the accelerator grid 2 by rotating the rolls 11 about their axes, each of the rolls then being provided with a threaded groove, thereby causing the wires to move in the plane of each grid. The rolls are fixed in their new positions by means of the wedges 20.

For example, by using a Km 6 cathetometer, the geometrical accuracy of the parameters of the ion-optics system can be guaranteed to within ±0.01 mm.

The ability to perform the adjustments specified makes it possible to increase the operating stability of the source of ions since high accuracy is guaranteed in the positioning of the wires relative to one another in each grid and in the desired magnitude of the inter-grid clearance 10. Mutual positioning of the wires is maintained through operation of the system, thereby ensuring operation that is stable and durable for the source of ions.

Because of its excellent performance, the ion-optics system of the invention having grids of wires is applicable to extensive ion sources that make use of gas ionization obtained by one of the following processes:

ionization by electronic bombardment (so-called Kaufman ion sources);

ionization by radiofrequency field (radio-frequency ionization thruster (RIT) ion sources); or else ionization by electron cyclotron resonance (ECR).

This optical system is particularly suitable for: providing thrust in space where it replaces conventional bulging grids; or industrial applications: etching microcircuits, ion machining, vacuum deposition by sputtering.

For such industrial applications, ion-optics using wires presents two essential advantages:

ion beam divergence in a plane parallel to the wires is very small, which is advantageous for etching applications; and since the perveance of an optical system using wires is very high, it is possible to extract increased ion density for given net acceleration voltage, which is advantageous in medium energy industrial applications (500 eV).

We claim:

1. An ion-optics system for a source of ions for discharge into gases, the system comprising a screen grid (1) and an accelerator grid (2) constituted by respective frames (3 and 4) and respective systems of parallel wires (5 and 6) fixed to the frames (3 and 4) by means of springs (21), the frames (3 and 4) of the grids (1 and 2) being assembled to each other via insulators (7) to which they are fixed, the system being characterized in that it is provided with a displacement device (9) for adjusting the wires in each of the grids (1 and 2), which device comprising rolls (11) disposed transversely relative to the wires (5 and 6) in each grid (1 and 2) and offering guide elements (12) in which the wires (5 and 6) are placed, the rolls (11) being installed on the frames (3 and 4) of the grids (1 and 2) with the facility of rotating about their own axes and of changing position in three dimensions together with the wires (5 and 6).

2. An ion-optics system according to claim 1, characterized in that each roll (11) is mounted by means of a length of shaft that is hinged to the frame and by means of an opposite length of shaft installed in an eccentric sleeve (16) mounted in the frame with the possibility of rotating about its axis.

3. An ion-optics system according to claim 1, characterized in that each roll (11) installed via its lengths of shaft in eccentric sleeves (16) disposed in the frame with the possibility of rotating about their axes, one of the lengths of shaft of each roll (11) being hinged to its eccentric sleeve (16).

4. An ion-optics system according to claim 1, characterized in that the guide elements (12) of the rolls are implemented in the form of a screw thread (14) at a pitch that is equal to the pitch of the wires or that is smaller in an integer ratio thereto.

5. An ion-optics system according to claim 1, characterized in that the wires (6) of the accelerator grid (2) are made with a diameter that is greater than the diameter of the wires (5) of the screen grid (1).

6. An ion-optics system according to claim 1, characterized in that the wires (5) of the screen grid (1) are disposed at a pitch that is smaller than the pitch of the wires (6) of the accelerator grid (2), and in an integer ratio thereto.

7. An ion-optics system according to claim 1, characterized in that the rolls (11) installed in the screen grid (1) are shaped in sections equal to the pitch of the wires (6) in the accelerator grid (2), in such a manner that the distance between the wires (5) of the screen grid (1) and the installation plane of the wires (6) of the accelerator grid (2) increases within each section going from its edges towards its center.

8. An ion-optics system according to claim 7, characterized in that each of the wires (5) of the screen grid (1) is constituted by at least three wires disposed in a determined geometrical pattern.

9. An ion-optics system according to claim 5, characterized in that the wires (6) of the accelerator grid (2) are made up of two coaxial portions (26, 27), the outer portion (26) being made in the form of a removable tube (28) that is installed and a good fit on the inner portion (27).

10. An ion-optics system according to claim 9, characterized in that the inner portion (27) of each wire (6) of the accelerator grid (2) has a diameter equal to the diameter of the wires (5) of the screen grid (1).

11. An ion-optics system according to claim 1, characterized in that springs (21) are installed parallel to the rolls (11) for the purpose of fixing the wires of the grids (1 and 2), the springs being disposed in at least one row (22) on either side of the frame of the grid and being implemented in the form of spring blades (24).

12. An ion-optics system according to claim 11, characterized in that the springs (21) are disposed on either side of the grid frame in a plurality of rows (23), the springs of adjacent rows being offset relative to one another by a distance that is a multiple of the pitch of the guide elements (12) of the rolls (11).

* * * * *

UNITED STATES PATENT AND TRADEMARK OFFICE

CERTIFICATE OF CORRECTION

PATENT NO. : 5,444,258

DATED : August 22, 1995

INVENTOR(S) : Vladimir G. Grigoryan, et al.

It is certified that error appears in the above-indentified patent and that said Letters Patent is hereby corrected as shown below:

On the cover page, after the line identified as "[21] Appl. No.: 211,676, the following PCT information is missing and should be inserted as follows:

-- [22] PCT Filed: August 24, 1993

[86] PCT No: PCT/FR93/00823

§ 371 Date: April 12, 1994

§ 102(e) Date: April 12, 1994

[87] PCT Pub. No: WO 94/05033

Pub. Date: March 3, 1994

UNITED STATES PATENT AND TRADEMARK OFFICE

CERTIFICATE OF CORRECTION

PATENT NO. : 5,444,258

DATED : August 22, 1995

INVENTOR(S) : Vladimir G. Grigoryan, et al.

It is certified that error appears in the above-indentified patent and that said Letters Patent is hereby corrected as shown below:

[30] Foreign Application Priority Data

August 24, 1992 [RU] Russian .....PCT/RU92/00163 --

Column 5, line 4, "$O_1130_1$" should read --$O_1$-$O_1$--.

Column 6, line 1, "6 which is" should read --δ which is--.

Signed and Sealed this

Twelfth Day of March, 1996

*Attest:*

*Attesting Officer*

BRUCE LEHMAN

*Commissioner of Patents and Trademarks*